US005187884A

United States Patent [19]

Baggio et al.

[11] Patent Number: 5,187,884

[45] Date of Patent: Feb. 23, 1993

[54] CLOSURE LEVER DEVICE

[75] Inventors: Giorgio Baggio, San Martino Di Lupari; Claudio Zorzi, Silea, both of Italy

[73] Assignee: Nordica S.p.A., Montebelluna, Italy

[21] Appl. No.: 673,930

[22] Filed: Mar. 25, 1991

[30] Foreign Application Priority Data

Apr. 5, 1990 [IT] Italy ..... 82547 A/90

[51] Int. Cl.[5] ..... A43B 11/00; A43C 11/00

[52] U.S. Cl. ..... 36/50; 24/68 SK

[58] Field of Search ..... 36/50.1, 50.5, 117, 36/118, 119, 120, 121; 24/68 SK, 70 SK, 69 SK, 71 SK

[56] References Cited

U.S. PATENT DOCUMENTS

| | | | |
|---|---|---|---|
| 3,643,295 | 2/1972 | Schoch | 24/70 SK |
| 4,051,611 | 10/1977 | Chalmers | 36/50 |
| 4,193,171 | 3/1980 | Lichowsky | 24/68 SK |
| 4,470,175 | 9/1984 | Chiarella | 36/50 X |
| 4,541,147 | 9/1985 | Olivieri | 36/50 X |
| 4,893,384 | 1/1990 | Bidoia et al. | 24/68 SK |
| 4,951,364 | 8/1990 | Marega | 24/68 SK |

FOREIGN PATENT DOCUMENTS

| | | | |
|---|---|---|---|
| 0134618 | 3/1985 | European Pat. Off. | 36/50 |
| 31320425 | 5/1982 | Fed. Rep. of Germany | 36/117 |
| 3408124 | 10/1984 | Fed. Rep. of Germany | 36/50 |
| 2536968 | 6/1984 | France | 36/117 |

*Primary Examiner*—David T. Fidei
*Assistant Examiner*—Ted Kavanaugh
*Attorney, Agent, or Firm*—Guido Modiano; Albert Josif

[57] ABSTRACT

A lever, pivoted to a pair of brackets which protrude from the boot, is constituted by a hollow central body which is pivoted to the lever body and is internally threaded complementarily with respect to a pawl with which at least one traction element is associated. A cover is furthermore slidably associated with the hollow central body and interacts with a bellows for forcing the cover into abutment with the pawl. Thus, a rotation imparted to the pawl, for example by means of the traction element, is followed by a movement of the cover which allows the skier to immediately visualize the degree of adjustment of the tension which can be imparted to the traction element.

12 Claims, 1 Drawing Sheet

CLOSURE LEVER DEVICE

BACKGROUND OF THE INVENTION

The present invention relates to a lever device particularly usable in ski boots.

Several devices are known for closing the quarters of the ski boots such as levers having one end pivoted to a pair of brackets which protrude from a plate associated with a flap of the boot; these levers are usually provided with an array of equidistant teeth.

The end of a ring, which is associated with another flap to be fastened, can be engaged on the teeth.

These known devices allow a rough adjustment by engaging the ring with the teeth defined on the lever, but have the considerable disadvantage of forcing the skier, every time he puts the boot on, to look again for the exact position of the ring on the teeth of the lever in order to achieve the preferred degree of closure of the boot.

One should in fact bear in mind that ski boots usually have more than one lever, so that the skier should be able to memorize the different positions of the ring at the selected teeth for each of the levers, and this is certainly not easy.

Closure devices are also known in which an arm is articulated to the lever and has a hook-like element to which it is possible to impart a preset movement along the axis which is longitudinal to the arm; the ring engages at adapted seats defined on an anchoring plate which is associated with the other flap to be closed.

Even this known solution, disclosed in the German patent no. 2157948 filed on Nov. 23, 1971, which claims a Swiss priority dated Nov. 25, 1970, has the disadvantage of not allowing an effective and simple visualization of the degree of micrometric adjustment selected by the skier.

The above closure device can furthermore jam because of the possible introduction of snow, and therefore because of icing of the region provided with the means for adjusting the sliding of the hook element longitudinally with respect to the arm.

U.S. Pat. No. 4,051,611, filed on Jan. 24, 1977, discloses a lever which is articulated to a pair of brackets protruding from a plate associated with a flap and to which an intermediate element is pivoted. The intermediate element has a threaded stem with which a pawl is selectively associable; a ring element is articulated to one end of the pawl and can be arranged at an adapted rack which can be associated with the other flap to be moved closer.

Even this described solution has the disadvantage of not allowing an effective and simple visualization of the degree of micrometric adjustment selected by the user, forcing the user to repeat the closing operation several times in order to check the optimum degree of fastening achieved during the previous use of the boot.

SUMMARY OF THE INVENTION

The aim of the present invention is therefore to eliminate the disadvantages described above in known types by providing a device which allows the skier to simply and effectively visualize the degree of adjustment, especially the micrometric one, selected for the lever.

An important object is to provide a device which allows to achieve the above aim by means of an economical solution.

Within the scope of the above described aim, another important object is to provide a device which preserves the lever from possible malfunctions or jammings due to the presence of snow or ice.

Still another object is to provide a structurally simple device as well as reliable and safe in use.

This aim, these objects and others which will become apparent hereinafter are achieved by a closure lever device, particularly for fastening a ski boot, which is pivoted to a pair of brackets protruding from a plate associated with said ski boot, characterized in that it comprises a hollow central body pivoted to a lever body and is internally threaded complementarily with respect to a pawl, at least one traction element being associated with said pawl, a cover being slidably associated with said central body and interacting with at least one resilient member adapted to bias said cover into abutment with said pawl.

BRIEF DESCRIPTION OF THE DRAWINGS

Further characteristics and advantages of the invention will become apparent from the detailed description of a particular but not exclusive embodiment, illustrated only by way of non-limitative example in the accompanying drawings, wherein.

DESCRIPTION OF THE PREFERRED EMBODIMENTS

Figure 1:
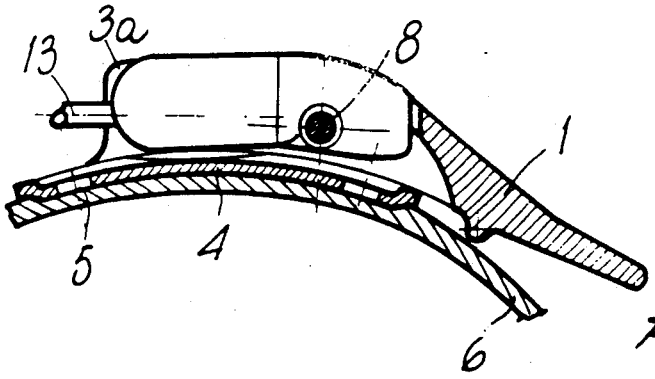
FIG. 1 is a partially side sectional view of the lever, according to the invention.
Figure 2:
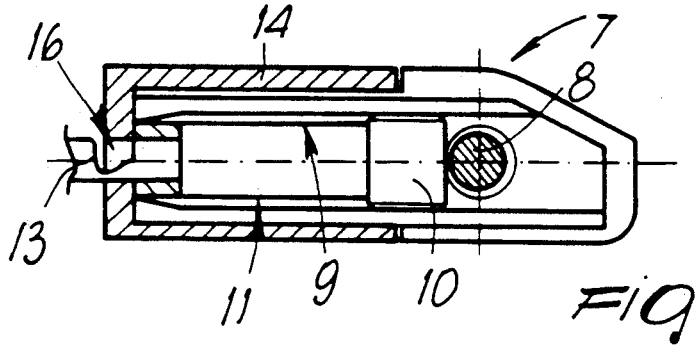
FIG. 2 is a sectional view, taken along a longitudinal median axis, of the central body, of the cover which is slidably associated therewith, and of the pawl.
Figure 3:
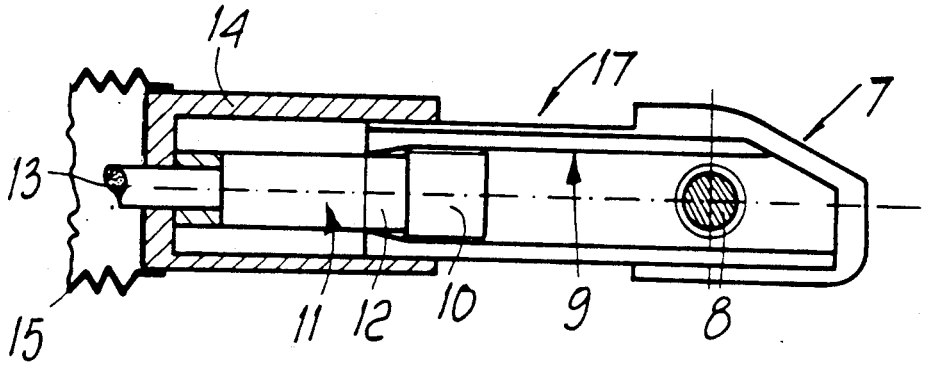
FIG. 3 is a view, similar to the preceding one, in the condition in which the cover is spaced with respect to the central body.
Figure 4:
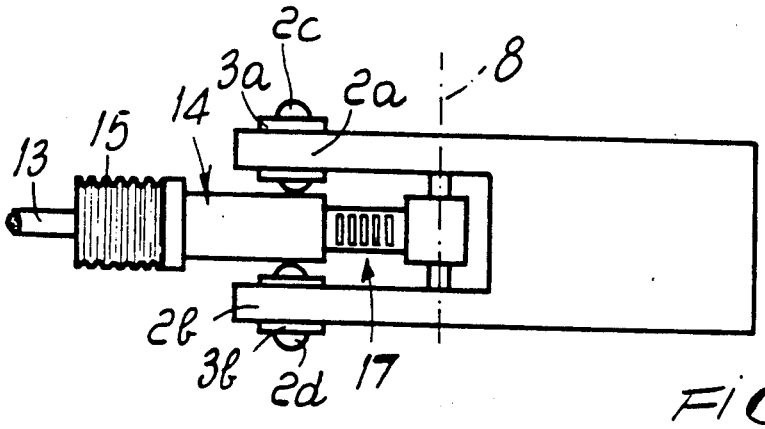
FIG. 4 is a top view of the lever.

With reference to the above figures, the reference numeral 1 indicates a lever body which has one concave end defining a pair of wings 2*a* and 2*b* pivoted, by means of a pair of rivets 2*c* and 2*d*, to a pair of brackets 3*a* and 3*b* which protrude in a perpendicular manner, along approximately parallel planes, from a plate 4 which has adapted first holes 5 for means suitable for rigidly associating said plate at an adapted flap or shell 6 of a ski boot.

The closure lever according to the invention can naturally also be used for fastening items of footwear of different types, such as for example ice-skates, roller skates, sports shoes or boots etc., fastening two flaps to one another or a flap to a fixed part.

The closure lever comprises a hollow central body 7 which is pivoted, by means of a pivot 8, to the lever 1 approximately at a median region of said lever and inside the space defined between the wings 2*a* and 2*b* of the lever 1

Said hollow central body 7 is internally provided with a threaded region 9 which is the seat of a complementarily threaded head 10 of a pawl 11.

Said hollow central body 7 is pivoted at the pivot 8 proximate to its end which is not directed toward the pair of brackets 3*a* and 3*b*.

The threaded region 9 thus affects the hollow central body 7 starting approximately from the region provided with the pivot 8 up to the open end 12 which is directed toward the pair of brackets 3*a* and 3*b*; the threaded region 9 ends just before the open end so as to prevent the escape of the head 10.

The pawl 11 has, at the end opposite to the head 10, a traction element which is rigidly associated therewith and is indicated by the numeral 13; said traction element can be constituted by a cable which is rigidly associated or associable by known means to the other flap of the ski boot.

The lever furthermore comprises a cover 14 which is slidably associated externally with respect to the hollow central body 7; said cover is retained against the hollow central body 7 and in abutment with the pawl 11 by means of a resilient member such as for example a bellows 15.

At one end, the cover 14 naturally has a second hole 16 for the exit of the traction element 13, and the end of the pawl 11 which is opposite to the head 10 abuts proximate thereto at the internal surface.

The operation of the lever is in fact as follows: once a rotation has been imparted to the pawl 11 and therefore to its head 10, either directly, by means of the traction element 13, or by means of adapted devices such as knobs, the cover 14 is moved with respect to the hollow central body 7.

Said movement is in fact achieved since the pawl 11 abuts with the cover 14 while the hollow central body 7 is articulated to the lever 1 along the pivot 8.

The translatory motion of the cover 14 with respect to the hollow central body 7 thus exposes a region 17 thereof which was previously concealed and on which adapted visualization elements, such as for examples marking notches, can be provided.

The exposure of said notches, which can have for example different colorings according to the chosen adjustment, allows the skier to easily and rapidly visualize the selected degree of adjustment.

If instead the rotation imparted to the pawl 11 causes the head 10 to move toward the pivot 8, a resilient member, such as the bellows 15, pushes the cover 14 onto the hollow central body 7, partially or totally concealing the region 17.

It has thus been observed that the invention has achieved the intended aim and objects, a lever having been provided which allows the skier to simply and effectively visualize the degree of adjustment, especially the micrometric one, selected for said lever.

The lever according to the invention is furthermore structurally simple and therefore requires low manufacturing costs.

The concealment of the pawl 11 within the hollow central body 7 furthermore allows to achieve the required micrometric adjustment while preserving the adjustment element from possible infiltrations of snow or ice, thus making it free from malfunctions or jammings.

The display of the degree of micrometric adjustment thus achieved furthermore occurs at the lever, which is the element gripped directly by the skier during closure and therefore is immediately visualized.

The closure lever according to the invention is naturally susceptible to numerous modifications and variations, all of which are within the scope of the same inventive concept.

The materials and the dimensions which constitute the individual components of the invention may also be the most pertinent according to the specific requirements.

We claim:

1. A closure lever device, particularly for ski boots, comprising:

a lever body having a pair of wings between which is defined a space;

means for pivotally connecting said pair of wings of said lever body to a boot;

a central body having an open end in which is provided a longitudinal threaded seat;

means for pivotally connecting said central body to said lever body, said central body being arranged at least partially in said space between said pair of wings of said lever body; and a traction element having a threaded pawl end which is screwed within said longitudinal threaded seat of said central body;

wherein the closure lever device further comprises a cover element which is slidingly connected to said central body and which covers said open end thereof, said cover element being freely pivotally connected to said traction element and moving translationally therewith when said traction element is rotated.

2. The closure lever device of claim 1, wherein said open end of said central body is arranged in said space between said pair of wings of said lever body and said cover element is at least partially arranged in said space.

3. The closure lever device of claim 2, wherein said cover element is completely arranged in said space in a fully closed position of said cover element with respect to said central body.

4. The closure lever device of claim 1, further comprising a region provided with visualization elements, said region having a degree of exposure which is determined by the relative position of said cover element with respect to said central body.

5. The closure lever device of claim 4, wherein said cover element is slidingly connected externally to said central body and said visualization region is provided externally on said central body.

6. The closure lever device of claim 1, wherein said means for pivotally connecting said central body to said lever body comprise a pivot which transversely extends in said space between said pair of wings of said lever body.

7. The closure lever device of claim 1, wherein said means for pivotally connecting said pair of wings of said lever body to a boot comprise a plate having brackets protruding therefrom, and pivots for pivotally connecting said pair of wings to said brackets, said plate being provided with holes for connecting said plate to the boot.

8. The closure lever device of claim 1, wherein said longitudinal threaded seat is inwardly tapered at said open end of said central body so as to prevent the escape of said threaded pawl end.

9. The closure lever device of claim 1, further comprising a resilient bellows element provided around said traction element and in contact with said cover element.

10. A closure lever device, particularly for ski boots, comprising:

a lever body having a pair of wings between which is defined a space;

means for pivotally connecting said pair of wings of said lever body to a boot;

a central body having an open end in which is provided a longitudinal threaded seat;

means for pivotally connecting said central body to said lever body, said central body being arranged at least partially in said space between said pair of wings of said lever body; and a traction element having a threaded pawl end which is screwed within said longitudinal threaded seat of said central body;

wherein the closure lever device further comprises a cover element which is slidingly connected to said central body and which covers said open end thereof, said cover element being freely pivotally connected to said traction element and moving translationally therewith when said traction element is rotated, said open end of said central body being arranged in said space between said pair of wings of said lever body and said cover element being at least partially arranged in said space, the closure lever device further comprising a region provided with visualization elements, said region having a degree of exposure which is determined by the relative position of said cover element with respect to said central body.

11. The closure lever device of claim 10, wherein said cover element is completely arranged in said space in a fully closed position of said cover element with respect to said central body.

12. The closure lever device of claim 10, wherein said cover element is slidingly connected externally to said central body and said visualization region is provided externally on said central body.

* * * * *